US008006663B2

(12) United States Patent
Hosaka

(10) Patent No.: US 8,006,663 B2
(45) Date of Patent: Aug. 30, 2011

(54) POST-START CONTROLLER FOR DIESEL ENGINE

(75) Inventor: Ryota Hosaka, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 288 days.

(21) Appl. No.: 12/428,723

(22) Filed: Apr. 23, 2009

(65) Prior Publication Data

US 2009/0271098 A1 Oct. 29, 2009

(30) Foreign Application Priority Data

Apr. 25, 2008 (JP) ..... 2008-115852

(51) Int. Cl.
*F02P 23/00* (2006.01)

(52) U.S. Cl. ..... 123/143 R; 123/145 A; 123/179.5

(58) Field of Classification Search ..... 123/143 R, 123/145 A, 179.1, 179.5, 179.6
See application file for complete search history.

(56) References Cited

U.S. PATENT DOCUMENTS

| | | | | |
|---|---|---|---|---|
| 4,367,639 | A * | 1/1983 | Kantor | 62/499 |
| 5,231,962 | A * | 8/1993 | Osuka et al. | 123/299 |
| 5,617,831 | A * | 4/1997 | Shirakawa | 123/502 |
| 7,043,900 | B2 * | 5/2006 | Shirakawa et al. | 60/280 |

FOREIGN PATENT DOCUMENTS

JP 6-3168 1/1994

* cited by examiner

*Primary Examiner* — John T Kwon
(74) *Attorney, Agent, or Firm* — Smith, Gambrell & Russell, LLP

(57) ABSTRACT

A glow power selected from a map based on a coolant temperature and an intake air temperature is applied to a glow plug provided at a combustion cylinder after an engine starts. Air-fuel mixture is heated and combusted, and then a rotation variation is calculated from a difference between a maximum rotating speed and a minimum rotating speed of the combustion cylinder. If the rotation variation is outside an allowable range with reference to an average rotation variation for four cylinders, the glow power corresponding to the combustion cylinder is corrected by a correction value set based on the rotation variation, thereby equalizing rotation variations for all cylinders.

8 Claims, 4 Drawing Sheets

POST-START CONTROLLER FOR DIESEL ENGINE

CROSS REFERENCE TO RELATED APPLICATIONS

The disclosure of Japanese Patent Application No. 2008-115852 filed on Apr. 25, 2008 including the specification, drawings and abstract is incorporated herein by reference in its entirety.

BACKGROUND OF THE INVENTION

1. Field of the Invention

The present invention relates to a post-start controller for a diesel engine, which reduces rough idle after an engine starts by controlling a heating temperature of a glow plug.

2. Description of the Related Art

In diesel engines, a target fuel injection amount is set with reference to a map based on an engine speed and an engine temperature (typically, a coolant temperature) as parameters in a period from cranking with a starter motor until the engine speed reaches a certain speed. After the engine speed reaches a preset stable speed, the control shifts to post-start control.

In the post-start control, it is checked on the basis of an accelerator opening etc. whether an operating state is an idle operation in which an accelerator pedal is released. If the operating state is the idle operation, a target idle speed is set mainly in accordance with the engine temperature, and feedback control is provided to a fuel injection amount such that a current engine speed becomes the target idle speed.

If individual cylinders have an equivalent combustion state, all cylinders have an equivalent interval rotating speed (an average angular speed from a top dead center to a bottom dead center) in combustion strokes of the individual cylinders, thereby providing a stable engine speed.

In contrast, even when the engine shifts from cold start to idle operation after the engine starts, if the engine temperature is low, combustion becomes unstable, likely producing rough idle. For example, when an interval rotating speed in a combustion stroke of a cylinder is significantly deviated from interval rotating speeds of other cylinders, in a four-cylinder engine in which a combustion stroke is provided every 180 deg-CA (crank angle), for example, waviness of deflection around a crank appears every four combustion strokes. This produces rough idle and causes a driver to feel uncomfortable.

Variation in combustion state among the cylinders is caused by individual differences, such as variation in fuel injection amount from injectors respectively arranged at the individual cylinders, variation in compression ratio among the cylinders, and variation in heating temperature of glow plugs.

For example, Japanese Examined Patent Application Publication No. 6-3168 discloses a technique as a countermeasure to address the above-mentioned problem. The technique detects a rotation variation of an individual cylinder from an engine speed during idle operation, and compares the rotation variation with an average value of rotation variations of all cylinders. If the rotation variation of the cylinder is smaller than the average value, a correction amount for increasing a fuel injection amount of the cylinder is set. If the rotation variation of the cylinder is larger than the average value, a correction amount for decreasing a fuel injection amount of the cylinder is set. Then, to calculate a next fuel injection amount of the cylinder, the fuel injection amount is corrected by using the previously set correction value. Thus, the combustion states among the cylinders are equalized, thereby providing a stable idle rotating speed.

Meanwhile, during idle operation (warm-up operation) after cold start, combustion is unstable. An interval rotating speed in a combustion stroke of a single cylinder is likely significantly deviated from interval rotating speeds in combustion strokes of other cylinders.

The technique disclosed in Japanese Examined Patent Application Publication No. 6-3168 provides the stable idle rotating speed by increasing or decreasing the fuel injection amount of the cylinder having the deviated interval rotating speed. However, if the fuel injection amount of the single cylinder is increased or decreased, an air-fuel ratio may be markedly varied. This may increase emission and, when the fuel injection amount is increased, this may increase fuel consumption.

SUMMARY OF THE INVENTION

In light of the situation, an object of the present invention is to provide a post-start controller for a diesel engine, which can provide good drivability by reducing rough idle without increasing emission or fuel consumption during idle operation immediately after an engine starts.

To attain this, a post-start controller for a diesel engine according to an aspect of the present invention includes a glow plug provided at each of individual cylinders of the engine; and power control means for applying power to the glow plug by a preset power after cranking of the engine is started. Also, the power control means includes rotation variation calculating means for calculating a rotation variation of each of the individual cylinders, rotation variation determining means for determining whether the rotation variation of each of the individual cylinders is within an allowable range, and power correcting means for correcting the preset power applied to the cylinder such that the rotation variation falls within the allowable range if the rotation variation determining means has determined that a rotation variation of any of the individual cylinders is outside the allowable range.

With the aspect of the present invention, in idle operation immediately after the engine starts, the preset power applied to the glow plug of the combustion cylinder is corrected such that the rotation variation falls within the allowable range if the rotation variation due to combustion of the combustion cylinder is outside the allowable range. Accordingly, all cylinders have substantially equivalent combustion of air-fuel mixture electrically heated by the corrected preset power. Rough idle can be reduced without increasing emission or fuel consumption. Thus, good drivability can be provided.

DESCRIPTION OF THE PREFERRED EMBODIMENT

Figure 1:
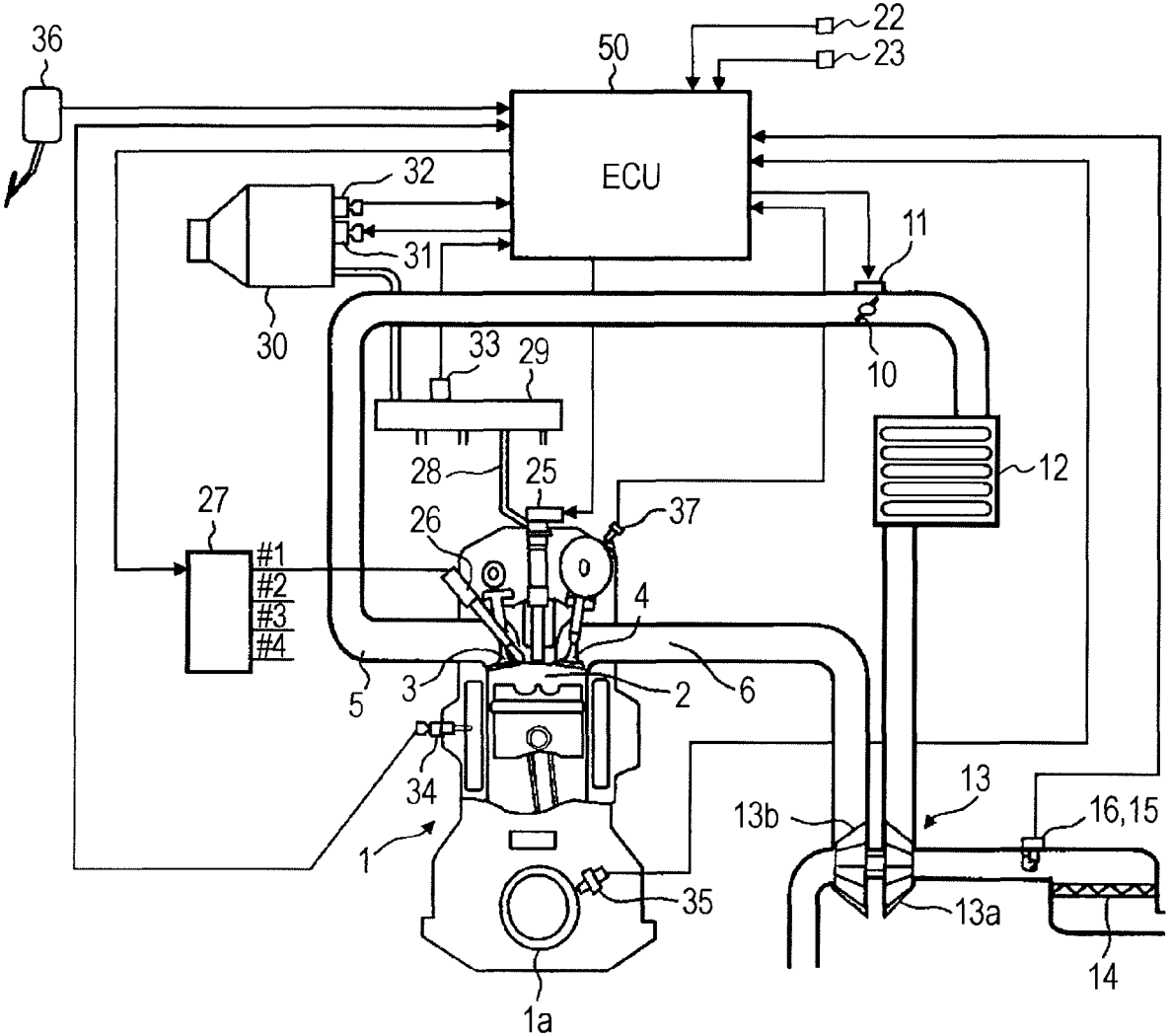
FIG. 1 is a general configuration diagram showing an engine control system.

An embodiment of the present invention will be described with reference to the attached drawings. FIG. 1 is a general configuration diagram showing an engine control system.

In FIG. 1, a diesel engine (merely referred to as "engine" hereinafter) 1 is a four-cylinder engine in this embodiment. Each cylinder of the engine 1 has a combustion chamber 2. The combustion chamber 2 has an intake port and an exhaust port. The ports respectively have an intake valve 3 and an exhaust valve 4 for opening and closing the ports. In FIG. 1, the position of the intake valve 3 is overlapped with the position of the intake port, and the position of the exhaust valve 4 is overlapped with the exhaust port. Hence, numerals of the intake port and the exhaust port are omitted.

Also, the intake port and the exhaust port are respectively connected to downstream ends of an intake passage 5 and an exhaust passage 6. Intake passages 5 extending from all cylinders to the upstream side are combined into a single passage in the middle, which is connected to an air cleaner 14. Exhaust passages 6 extending from all cylinders are combined into a single passage in the middle, which is connected to an exhaust muffler (not shown).

A throttle valve 10 is arranged in a combined portion of the intake passages 5 at the upstream side. An intake actuator 11 is disposed beside the throttle valve 10. The intake actuator 11 is driven in response to a control signal from an engine control unit (ECU) 50 which will be described later. The intake actuator 11 adjusts an opening of the throttle valve 10, to control an intake air amount to be supplied to the combustion chambers 2 of the individual cylinders.

An intercooler 12 is arranged upstream of the throttle valve 10. A compressor 13*a* of a turbosupercharger 13 is arranged upstream of the intercooler 12. Further, an intake air amount sensor 16 is exposed to the immediately downstream side of the air cleaner 14. The intake air amount sensor 16 detects an intake air amount. The intake air amount sensor 16 contains an intake air temperature sensor 15 that detects an intake air temperature Tin.

A turbine 13*b* of the turbosupercharger 13 is arranged in a passage portion at which the exhaust passages 6 of the engine 1 are combined. Exhaust gas passed through the turbine 13*b* is purified to a predetermined level when passing through a diesel oxidation catalyst (DOC) and a diesel particulate filter (DPF), and then is exhausted through the exhaust muffler (not shown).

Next, a fuel injection system of the engine 1 will be described. The engine 1 of this embodiment employs a known common-rail fuel injection system. An injector 25 serving as fuel injection means controlled by the ECU 50 (described later) is exposed to the combustion chamber 2. Also, a glow plug 26 is exposed to a portion of the combustion chamber 2 near an injection nozzle of the injector 25.

The injector 25 is connected to a common rail 29 through a fuel pipe 28 which is divided into all cylinders. A supply pump 30 is connected to the common rail 29. The supply pump 30 applies a pressure to the fuel sucked from a fuel tank (not shown). The fuel, the pressure of which is increased by the supply pump 30, is accumulated in the common rail 29, and the accumulated high-pressure fuel is supplied to the injectors 25 of the individual cylinders through the fuel pipe 28.

The supply pump 30 includes, for example, an inner-cam pressure feed system and an intake amount metering system with a solenoid valve. An intake metering solenoid valve 31 that adjusts an intake amount and a fuel temperature sensor 32 that detects a fuel temperature are arranged in a main body of the supply pump 30. A signal from the fuel temperature sensor 32 of the supply pump 30 and a signal from a fuel pressure sensor 33 that detects a fuel pressure (a rail pressure) in the common rail 29 are input to the ECU 50 (described later), and processed together with signals from other sensors. The ECU 50 (described later) provides feedback control such that a discharge pressure of the supply pump 30 is adjusted to an optimum value in accordance with, for example, an engine speed and a load. Thusly, the fuel pressure of the common rail 29 is set to a preset value.

The glow plug 26 provided at each of the individual cylinders is connected to the output side of the ECU 50 through a glow controller 27. Though not shown, the glow controller 27 has a glow relay connected to the glow plug 26 of each cylinder, and a glow potential generating portion that generates a glow potential(=power) by pulse width modulation (PWM) control, the glow potential being applied to a specific glow plug 26 through the glow relay. When the glow relay is turned ON, the glow potential generated by the glow potential generating portion is applied to the glow plug 26 connected to the glow relay, and hence the glow plug 26 generates heat. As a result, the glow plug 26 electrically heats air-fuel mixture, and assists ignition thereof.

The ON/OFF state of the glow relay and the glow potential generated by the glow potential generation portion are set on the basis of an individual cylinder electrical signal output from the ECU 50.

Next, an electronic control system around the ECU 50 will be described. The ECU 50 is formed of a known microcomputer including readable and writable nonvolatile storage means, such as a CPU, a ROM, a RAM, and an EEPROM. The ROM stores a control program executed by the CPU, and fixed data, such as a potential correction value table (described later). The nonvolatile storage means also stores an individual cylinder glow potential map Map#i (i=1, 2, 3, 4) as a control map (described later).

The input side of the ECU 50 receives input of signals from the intake air temperature sensor 15, the intake air amount sensor 16, an ignition switch 22, a starter switch 23, the fuel temperature sensor 32, the fuel pressure sensor 33, the coolant temperature sensor 34 which is exposed to a water jacket of the engine 1 and detects a coolant temperature Tw as a parameter for detecting an engine temperature, a crank angle sensor 35 having a function as engine speed detecting means for detecting an engine speed and the like on the basis of rotation of a crank shaft 1*a*, a cam angle sensor 37 that outputs a cylinder discriminating signal on the basis of rotation of a cam shaft 1*b* rotating at a rotating speed which is half the rotating speed of the crank shaft 1*a*, an accelerator pedal sensor 36 that detects an accelerator pedal depressing amount, and other sensors and switches (not shown).

The ECU 50 executes various engine controls, such as fuel pressure control, fuel injection control, intake control, and charging pressure control, in accordance with the signals from the sensors and switches, to maintain the operating state of the engine 1 in an optimum state.

Also, the ECU 50 functions as glow application control means (=power control means) for controlling a glow potential Vg as an afterglow application amount (=preset power) to be applied to the glow plug 26 after the engine starts. The application control (=power control) to the glow plug 26 is executed to improve startability by heating the inside of the combustion chamber 2 of each cylinder and increasing ignition quality of fuel. The application control includes application control (preglow control) executed in a period before the engine 1 starts until cranking ends, and application control (afterglow control) successively executed after cranking.

That is, when the ignition switch 22 is turned ON, the ECU 50 outputs an all cylinder application signal to the glow controller 27. Then, the glow controller 27 turns ON all glow relays, and the glow potential generating portion generates a preglow potential to be applied to the glow plugs 26 under the PWM control or the like. Then, the glow potential is applied to all glow plugs 26 so that the glow plugs 26 generate heat to achieve a preset temperature (for example, about 1000°). The generated heat is used to increase the temperature of the inside of the cylinders. After the temperature in the cylinders is increased to the preset temperature, the engine is permitted to start. While the engine is permitted to start, the starter switch 23 is turned ON, and cranking is started by driving of the starter motor. This application is continued to the glow plugs 26 even during cranking.

When the ECU 50 receives the cylinder discriminating signal from the cam angle sensor 37 and the engine speed Ne detected by the crank angle sensor 35, the ECU 50 discriminates a cylinder (a combustion cylinder) in a current combustion stroke, turns ON the glow relay of this combustion cylinder at a preset timing, and causes the glow plug connected to this glow relay to generate heat. It is to be noted that a cylinder to be shifted and being shifted to the combustion stroke, that is, a cylinder shifted from the exhaust stroke to the combustion stroke and being in the combustion stroke, is referred to as a combustion cylinder.

When the engine 1 is started and the starter switch 23 is tuned OFF, the preglow control is ended, and the control shifts to the afterglow control. The afterglow control is continued for a preset time (an afterglow time) after the starter switch 23 is turned OFF, or until the coolant temperature Tw detected by the coolant temperature sensor 34 becomes a preset temperature (an afterglow completion temperature).

Figure 2:
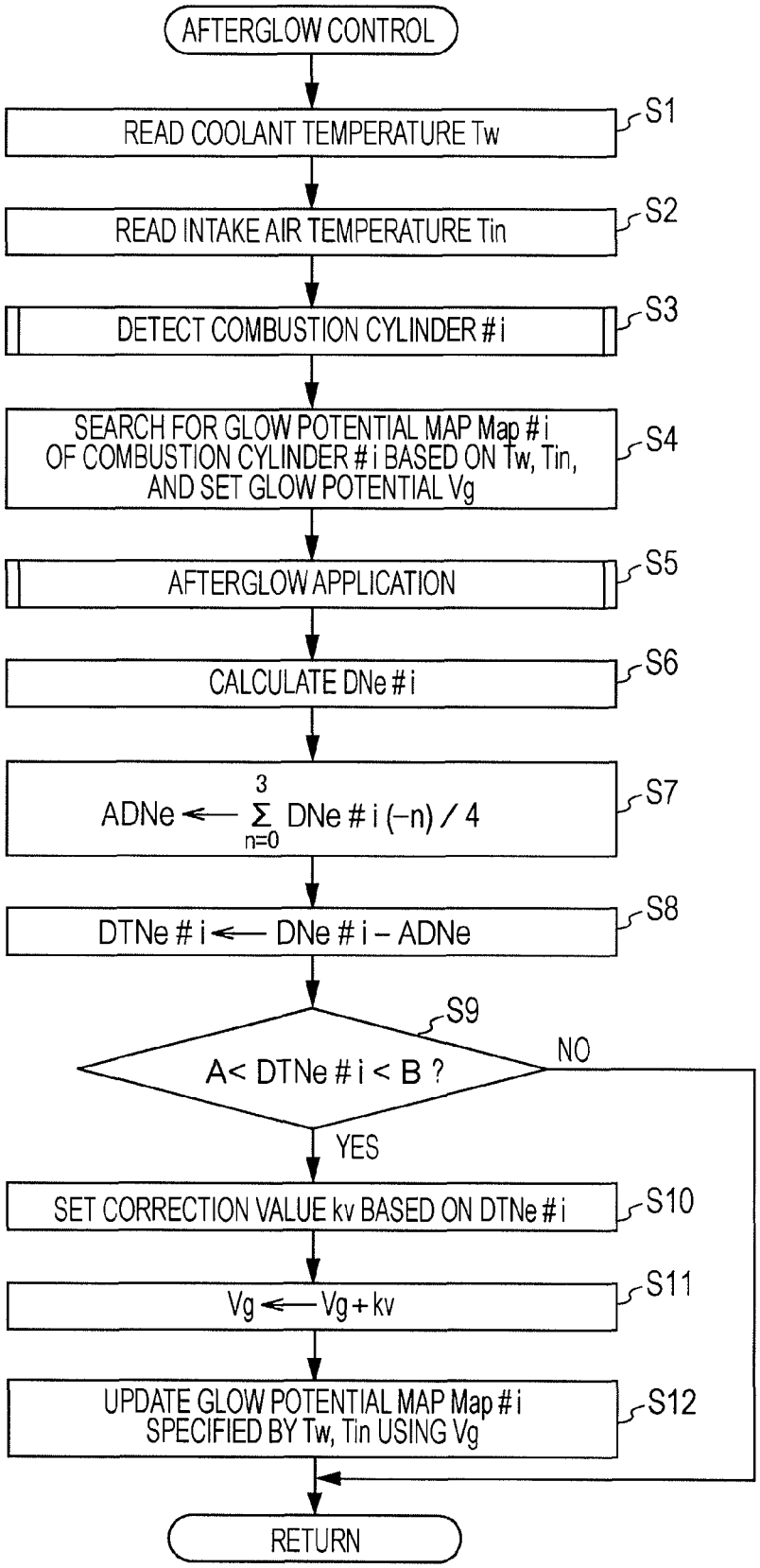
FIG. 2 is a flowchart showing an afterglow control routine.

In particular, the afterglow control by the ECU 50 is performed by an afterglow control routine shown in FIG. 2. As described above, this routine is started after the ignition switch is tuned ON and immediately after the starter switch 23 is turned OFF. The routine is executed every preset calculation period (for example, an angular period of every 1 deg-CA) for the preset afterglow time or until the coolant temperature Tw becomes the afterglow completion temperature.

In step S1, the coolant temperature Tw detected by the coolant temperature sensor 34 is read. In step S2, the intake air temperature Tin detected by the intake air temperature sensor 15 is read. In step S3, a combustion cylinder #i (i=1, 2, 3, 4) is discriminated on the basis of the cylinder discriminating signal output from the cam angle sensor 37. In this embodiment, the fuel is injected in order of #1, #2, #3, and then #4.

Meanwhile, various methods are known for discriminating the combustion cylinder. For example, an identification index for an individual combustion cylinder is provided on an outer periphery of a cam plate fitted on the cam shaft 1*b*, at a position corresponding to a top dead center of the cylinder or at a position slightly advanced from the position corresponding to the top dead center (i.e., every 180°). The cam angle sensor 37 detects the identification index, and outputs a pulse signal corresponding to the detected identification index, as a cylinder discriminating signal. The method of discriminating the cylinder is not limited to that described in this embodiment.

Figure 3:
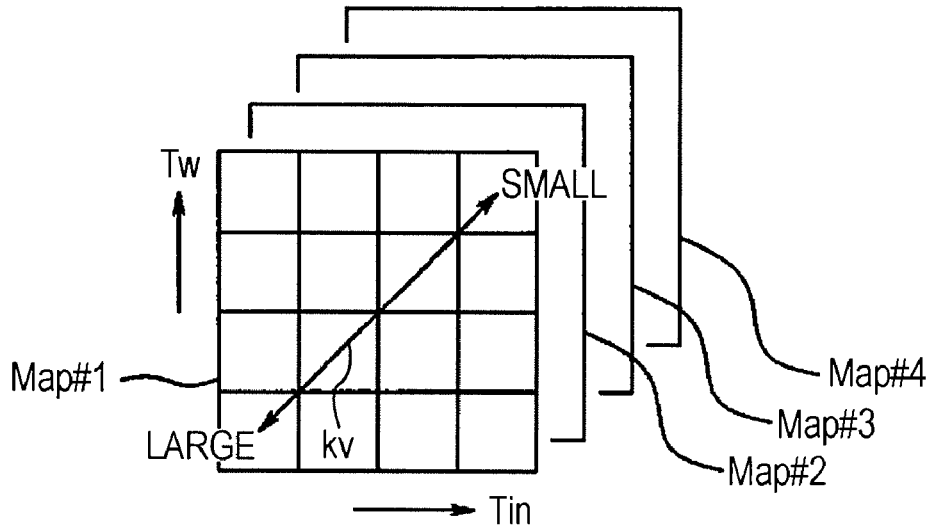
FIG. 3 is a conceptual diagram showing a glow potential map for an individual cylinder.

Then, in step S4, an individual cylinder glow potential map Map#i (i=1, 2, 3, 4) corresponding to the combustion cylinder #i is specified, the individual cylinder glow potential map Map#i is referred with interpolation calculation based on the coolant temperature Tw and the intake air temperature Tin as parameters for determining the cylinder temperature, and a glow potential Vg to be applied to the glow plug 26 disposed at the combustion cylinder #i is set. Referring to FIG. 3, the individual cylinder glow potential map Map#i is provided for each of the individual cylinders #1, #2, #3, and #4. The individual cylinder glow potential map Map#i stores basic glow potentials Vg previously obtained with an experiment or the like for all operation regions each of which is set in accordance with a coolant temperature Tw and an intake air temperature Tin serving as parameters for specifying an engine operating state.

A basic glow potential Vg stored in the individual glow potential map Map#i is a large value when a coolant temperature Tw and an intake air temperature Tin are low, and a basic glow potential Vg is gradually decreased when at least one of a coolant temperature Tw and an intake air temperature Tin is increased. Though described later, the glow potential Vg stored in the corresponding operation region is constantly updated.

Then, in step S5, afterglow application processing is executed, and the routine goes to step S6. The processing in step S5 corresponds to post-start application means of the present invention. The afterglow application processing outputs an individual cylinder application signal representing information of the combustion cylinder #i specified in step S3 and information of the glow potential Vg set in step S4. Then, the glow controller 27 turns ON the glow relay connected to the glow plug 26 provided at the specified combustion cylinder #i, and generates a glow potential corresponding to the glow potential Vg at the glow potential generating portion. The glow controller 27 applies the glow potential to the glow plug 26 only for a preset application time (an afterglow application time). As a result, the glow plug 26 generates heat at a temperature substantially proportional to the glow potential Vg, and the heat increases the temperature of air-fuel mixture in the cylinder.

Figure 4:
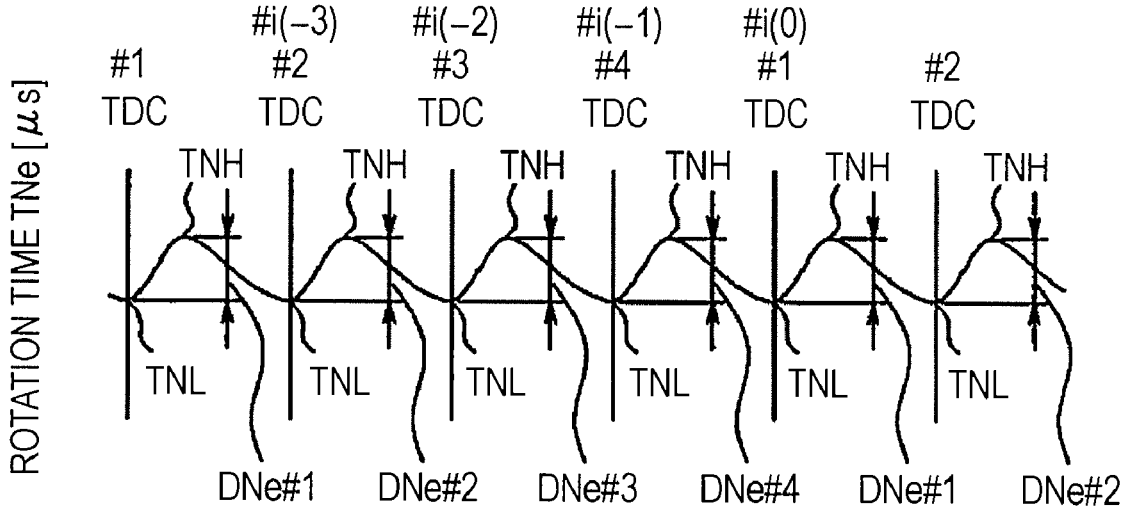
FIG. 4 is a time chart showing a rotation variation of an individual cylinder.

After the afterglow application time elapses, that is, after the combustion cylinder #i reaches a latter half phase of the combustion stroke, the routine goes to step S6, in which a rotation variation DNe#i is calculated for determining a combustion state of the combustion cylinder #i. The processing in step S6 corresponds to rotation variation calculating means of the present invention. In the combustion stroke, when the air-fuel mixture is combusted, the engine speed Ne is increased (see FIG. 4).

Various methods may be conceived for calculating the rotation variation DNe#i. For example, referring to FIG. 4, an instantaneous minimum rotation time TNL (μs) and an instantaneous maximum rotation time TNH (μs) are calculated on the basis of a rotation time TNe (μs) for a preset crank angle interval detected by the crank angle sensor 35. The rotation variation DNe#i (i=1, 2, 3, 4) (μs) of the combustion cylinder is calculated by using a difference between the rotation times TNH and TNL (i.e., DNe#i←TNH−TNL). For example, a crank angle interval indicating a minimum rotating speed (for example, BTDC 15 to ATDC 15 (deg-CA)) and a crank angle interval indicating a maximum rotating speed (for example, BTDC 45 to 75 (deg-CA)) are previously set, and instantaneous rotation times TNL and TNH are calculated in accordance with a time the crank angle sensor 35 relatively passes each crank angle interval.

Then, in step S7, an average rotation variation ADNe (μs) is calculated. The average rotation variation ADNe is calculated from an average of rotation variations DNe#i for previous four cylinders including the currently calculated combustion cylinder #i. In particular, referring to FIG. 4, in a case where the cylinder #i of the currently calculated rotation variation DNe#i is the cylinder #1, the average rotation variation ADNe is an average value of rotation variations DNe#i of four combustion cylinders #i(−n) (where n=0, 1, 2, 3) to the previous cylinder #2, which is the fourth cylinder counted in an ascending manner from the cylinder #1 including the cylinder #1.

Then, in step S8, a rotation variation deviation DTNe#i with reference to the average rotation variation ADNe is calculated from a difference between the rotation variation DNe#i and the average rotation variation ADNe (DTNe#i←DNe#i−ADNe).

Then, in step S9, it is determined whether the rotation variation deviation DTNe#i is within an allowable range by comparing the rotation variation deviation DTNe#i with a lower threshold value A and an upper threshold value B. The processing in steps S7 to S9 corresponds to rotation variation determining means of the present invention.

The allowable range set by the lower threshold value A and the upper threshold value B is a range equal to or slightly smaller than a range defined by a limit (rough idle limit) not causing an occupant to feel uncomfortable due to rough idle such as waviness of deflection around a crank, the range being preset with an experiment or the like.

Figure 5:
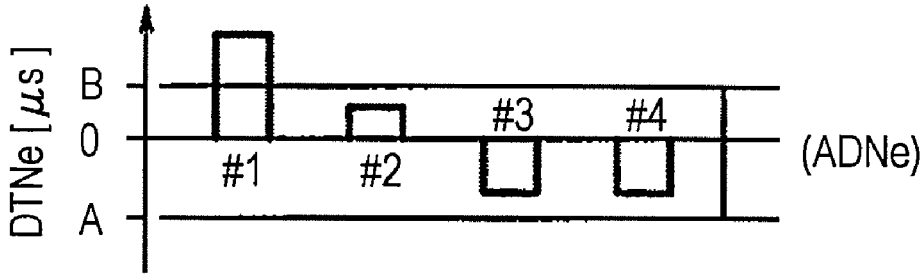
FIG. 5 is a time chart showing a rotation variation deviation of an individual cylinder.
Figure 6:
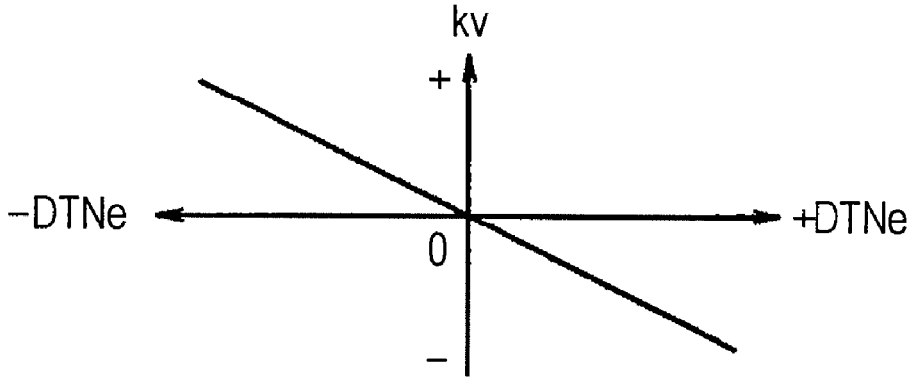
FIG. 6 is a conceptual diagram showing a glow potential correction value table.

If it is determined that the rotation variation deviation DTNe#i satisfies the allowable range of A<DTNe#i<B, the routine is ended. In contrast, if it is determined that the rotation variation deviation DTNe#i is outside the allowable range such that DTNe#i≦A, or B≦DTNe#i, that is, for example as shown in FIG. 5, if the rotation variation deviation DTNe#i of the cylinder #1 is above the upper threshold value B, the routine goes to step S10, in which a glow potential correction value table is referred with interpolation calculation based on the rotation variation DNe#i, and a glow potential correction value kv is set. Referring to FIG. 6, the glow potential correction value table stores a glow potential correction value kv having a negative inclination which is inclined in substantially proportional to the rotation variation DNe. Thus, the glow potential correction value kv is set to be decreased as the rotation variation DNe is increased from a negative value to a positive value. The glow potential correction value kv may be obtained with an expression based on the rotation variation DNe#i.

Then, in step S11, a new glow potential Vg is calculated (Vg←Vg+kv) by adding the glow potential correction value kv to the glow potential Vg read in step S4. Then, in step S12, the glow potential Vg stored in the region of the glow potential map Map#i of the combustion cylinder #i specified by the coolant temperature Tw read in step S1 and the intake air temperature Tin read in step S2 is updated with the currently calculated glow potential Vg, and the routine is ended. The processing in steps S10 and S11 corresponds to glow application amount updating means of the present invention.

As a result, when an operation cycle from engine start to engine stop is repeated, the glow potential Vg stored in the glow potential Map #i is optimized for every cylinder, thereby providing a desirable post-start idle operation.

Alternatively, the glow potential correction value kv may be a fixed value. In step S11, when the rotation variation DNe#i indicates a negative value, the glow potential correction value kv may be added to the current glow potential Vg to set a new glow potential Vg (Vg←Vg+kv). In contrast, when the rotation variation DNe#i indicates a positive value, the glow potential correction value kv may be subtracted from the current glow potential Vg to set a new glow potential Vg (Vg←Vg−kv).

As described above, in this embodiment, if the rotation variation deviation DTNe#i with respect to the average rotation variation ADNe of previous four combustion cylinders including the rotation variation DNe#i of the current cylinder #i is outside the preset allowable range (DTNe#i≦A, B≦DTNe#i), the glow potential Vg stored in the glow potential map Map#i of the combustion cylinder #i is corrected in accordance with the rotation variation deviation DTNe#i. Accordingly, by repeating the operation cycle from engine start to engine stop, combustion of all combustion cylinders #i can be equalized. As a result, individual differences, such as variation in compression ratio among the cylinders, variation in heating temperature of the glow plugs 26, and variation in injector characteristic can be absorbed, and the rotation variations DNe#i of the individual cylinders #i can be equalized. Accordingly, rough idle is reduced, and good drivability can be provided.

Since rough idle immediately after the engine starts is reduced by the glow application control, the fuel injection control may continuously employ existing control, and increase in emission or fuel consumption can be effectively avoided.

The present invention is not limited to the above-described embodiment. While the four-cylinder engine is described as an example of the engine 1, the number of cylinders is not limited to four. While the rotation variation DNe#i is obtained from the difference between the minimum rotating speed and the maximum rotating speed of the combustion cylinder #i, it may be obtained from a difference between rotating speeds at preset crank angles before combustion and after combustion. In this embodiment, while the rotation variation deviation DTNe#i is set with reference to the average rotation variation ANe of the four combustion cylinders, it may be set with reference to a preset ideal rotation variation.

In this embodiment, while the afterglow application amount is set with a potential Vg, it may be set with current instead.

What is claimed is:

1. A post-start controller for a diesel engine, comprising:

a glow plug provided at each of individual cylinders of the engine; and power control means for applying power to the glow plug by a preset power after cranking of the engine is started, wherein the power control means includes rotation variation calculating means for calculating a rotation variation of each of the individual cylinders, rotation variation determining means for determining whether the rotation variation of each of the individual cylinders is within an allowable range, and power correcting means for correcting the preset power such that the rotation variation falls within the allowable range if the rotation variation determining means has determined that the rotation variation of any of the individual cylinders is outside the allowable range.

2. The post-start controller for the diesel engine according to claim 1, wherein the power control means further includes a control map storing the preset power corresponding to every engine operation region of each of the individual cylinders, and power updating means for updating the preset power stored in the control map by a correction value provided by the power correcting means.

3. The post-start controller for the diesel engine according to claim 2, wherein the preset power stored in the control map is set by an engine temperature and an intake air temperature.

4. The post-start controller for the diesel engine according to claim 1, wherein the allowable range is equal to or smaller than a range defined by a rough idle limit.

5. The post-start controller for the diesel engine according to claim 2, wherein if the rotation variation determining means determines that the rotation variation is above the allowable range, the power updating means updates the preset power read from the control map by decreasing the preset power by a preset correction value.

6. The post-start controller for the diesel engine according to claim 2, wherein the power updating means updates the preset power read from the control map by decreasing the preset power by a correction value set in accordance with the rotation variation.

7. The post-start controller for the diesel engine according to claim 2, wherein if the rotation variation determining means determines that the rotation variation is below the allowable range, the power updating means updates the preset power read from the control map by increasing the preset power by a preset correction value.

8. The post-start controller for the diesel engine according to claim 2, wherein the power updating means updates the preset power read from the control map by increasing the preset power by a correction value set in accordance with the rotation variation.

* * * * *